US010128568B1

(12) United States Patent
Arney et al.

(10) Patent No.: US 10,128,568 B1
(45) Date of Patent: Nov. 13, 2018

(54) ELLIPTICAL CONICAL ANTENNA APPARATUS AND METHODS

(71) Applicant: SPAWAR Systems Center Pacific, San Diego, CA (US)

(72) Inventors: David V. Arney, El Cajon, CA (US); Dennis G. Bermeo, San Diego, CA (US); Glenn D. Snyder, Washington, DC (US); Hale B. Simonds, Santee, CA (US); Peter S. Berens, San Diego, CA (US)

(73) Assignee: The United States of America as represented by Secretary of the Navy, Washington, DC (US)

( * ) Notice: Subject to any disclaimer, the term of this patent is extended or adjusted under 35 U.S.C. 154(b) by 114 days.

(21) Appl. No.: 15/382,907

(22) Filed: Dec. 19, 2016

(51) Int. Cl.
*H01Q 1/36* (2006.01)
*H01Q 1/48* (2006.01)
*H01Q 9/40* (2006.01)

(52) U.S. Cl.
CPC ..... *H01Q 1/36* (2013.01); *H01Q 1/48* (2013.01); *H01Q 9/40* (2013.01)

(58) Field of Classification Search
CPC ..... H01Q 1/36
See application file for complete search history.

(56) References Cited

U.S. PATENT DOCUMENTS 2,501,020 A * 3/1950 Barnes ..... H01Q 9/40 343/831
6,449,103 B1 9/2002 Charles
6,842,141 B2 1/2005 Suh et al.
7,027,002 B2 4/2006 Suh et al.
8,441,409 B2 5/2013 Tatarnikov et al.
8,467,133 B2 6/2013 Miller
8,576,125 B2 11/2013 Ridgeway
8,706,914 B2 4/2014 Duchesneau
8,706,915 B2 4/2014 Duchesneau
8,730,118 B1 5/2014 McLean
8,964,298 B2 2/2015 Haddick et al.
9,143,392 B2 9/2015 Duchesneau
9,261,620 B2 2/2016 Mangione et al.
9,285,569 B2 3/2016 Osterhout et al.
2003/0210207 A1 11/2003 Suh et al.
2005/0062670 A1 3/2005 Suh et al.
2006/0187134 A1* 8/2006 Hoshi ..... H01Q 9/28 343/773
2007/0258329 A1 11/2007 Winey
2008/0297430 A1* 12/2008 Schano ..... H01Q 1/36 343/860
2009/0216910 A1 8/2009 Duchesneau
2011/0012808 A1 1/2011 Tatarnikov et al.
(Continued)

*Primary Examiner* — Daniel J Munoz

(74) *Attorney, Agent, or Firm* — SPAWAR Systems Center Pacific; Kyle Eppele

(57) ABSTRACT

An elliptical portion having planform cross-section involving a generally circular configuration and an elevational cross-section having at least a partial elliptical configuration; a conical portion having at least one of a conical configuration and a frustoconical configuration, the conical portion coupled with the elliptical portion; and a modifier feed, the modifier feed having a first feed element and a second feed element, whereby the antenna apparatus is configured to perform as a monopole antenna at a low frequency and as a hybrid monopole-biconical antenna at a high frequency.

20 Claims, 8 Drawing Sheets

(56) References Cited

U.S. PATENT DOCUMENTS

| | | | |
|---|---|---|---|
| 2011/0095935 | A1 | 4/2011 | Shim |
| 2011/0156981 | A1 | 6/2011 | Ridgeway |
| 2012/0212484 | A1 | 8/2012 | Haddick et al. |
| 2012/0212499 | A1 | 8/2012 | Haddick et al. |
| 2012/0218301 | A1 | 8/2012 | Miller |
| 2012/0242553 | A1 | 9/2012 | Leung et al. |
| 2013/0127980 | A1 | 5/2013 | Haddick et al. |
| 2013/0154846 | A1 | 6/2013 | Mangione et al. |
| 2013/0278631 | A1 | 10/2013 | Border et al. |
| 2013/0306276 | A1 | 11/2013 | Duchesneau |
| 2014/0163664 | A1 | 6/2014 | Goldsmith |
| 2014/0317315 | A1 | 10/2014 | Duchesneau |
| 2014/0347243 | A1 | 11/2014 | Abadi et al. |
| 2015/0301275 | A1 | 10/2015 | Andle et al. |

* cited by examiner

Low Frequency Elevation
Directivity Pattern

ELLIPTICAL CONICAL ANTENNA APPARATUS AND METHODS

FEDERALLY-SPONSORED RESEARCH AND DEVELOPMENT

The United States Government has ownership rights in the subject matter of the present disclosure. Licensing inquiries may be directed to Office of Research and Technical Applications, Space and Naval Warfare Systems Center, Pacific, Code 72120, San Diego, Calif., 92152; telephone (619) 553-5118; email: ssc_pac_t2@navy.mil. Reference Navy Case No. 102,881.

CROSS-REFERENCE TO RELATED APPLICATION(S)

This document is a continuation-in-part application, claiming the benefit of, and priority to, U.S. patent application Ser. No. 14/059,520, filed on Oct. 22, 2013, entitled "Omni-Directional Antenna with Extended Frequency Range," which is hereby incorporated by reference in its entirety.

BACKGROUND OF THE INVENTION

Technical Field

The present disclosure technically relates to antennas. Particularly, the present disclosure technically relates to omnidirectional antennas. More particularly, the present disclosure technically relates to simulation of omnidirectional antennas.

Description of Related Art

In the related art, such as in radio communication, an omnidirectional antenna involves a class of antenna that radiates radio wave power uniformly in all directions in one plane, wherein the radiated power decreases in relation to an elevation angle relative to a plane, e.g., dropping to zero on the antenna axis. The radiated power has a radiation pattern is "doughnut-shaped" or toroidal in contrast to an isotropic antenna which radiates equal power in all directions and has a "spherical" radiation pattern. Omnidirectional antennas oriented vertically are used in the related art as nondirectional antennas on the Earth's surface since omnidirectional antennas radiate equally in all horizontal directions while the radiated power decreases with elevation angle. As such, less radio energy is aimed into the atmosphere or toward the earth. Omnidirectional antennas are also used for radio broadcasting antennas as well as in mobile devices that use radio frequencies, such as cellular phones, FM radios, walkie-talkies, wireless computer networks, cordless phones, GPS, and base stations that communicate with mobile radios, such as first responders, common carrier dispatchers, and aircraft control towers.

However, the foregoing related art antennas tend to suffer losses due to mismatch effects at the antenna feed, have limited directivity, and limited performance in a wide range of frequencies. Therefore, a need exists for an antenna apparatus that improves performance by minimizing or eliminating losses due to mismatch effects at the antenna feed, have improved directivity, and improved performance in a wide range of frequencies.

SUMMARY OF THE INVENTION

To address at least the needs and challenges in the related art, an elliptical conical antenna apparatus is configured to simulate at least one of an omnidirectional antenna and a biconical antenna for enhancing antenna performance, e.g., by minimizing or eliminating losses due to mismatch effects at the antenna feed, have improved directivity, and improved performance in a wide range of frequencies.

In accordance with an embodiment of the present disclosure, an elliptical conical antenna apparatus for enhancing antenna performance, comprises: an elliptical portion having planform cross-section comprising a generally circular configuration and an elevational cross-section comprising at least a partial elliptical configuration; a conical portion comprising at least one of a conical configuration and a frustoconical configuration, the conical portion coupled with the elliptical portion; and a modifier feed, the modifier feed comprising a first feed element and a second feed element, whereby the antenna apparatus is configured to perform as a monopole antenna at a low frequency, whereby the antenna apparatus is configured to perform as a hybrid monopole-biconical antenna at a high frequency.

BRIEF DESCRIPTION OF THE DRAWING

The above, and other, aspects, features, and uses of several embodiments of the present disclosure are further understood from the following Detailed Description of the Invention as presented in conjunction with the following several figures of the Drawing.

Figure 1:
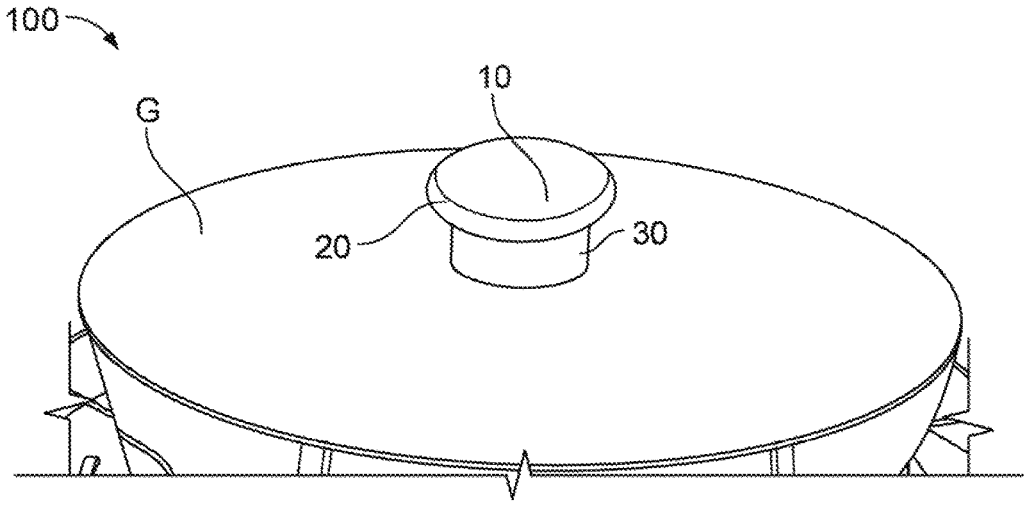
FIG. 1 is a diagram illustrating a top perspective view of an elliptical conical antenna apparatus, in accordance with an embodiment of the present disclosure.

Corresponding reference numerals or characters indicate corresponding components throughout the several figures of the Drawings. Elements in the several figures are illustrated for simplicity and clarity and have not necessarily been drawn to scale. For example, the dimensions of some of the elements in the figures may be emphasized relative to other elements for facilitating understanding of the various presently disclosed embodiments. Also, common, but well-understood, elements that are useful or necessary in a commercially feasible embodiment are often not depicted in order to facilitate a less obstructed view of these various embodiments of the present disclosure.

DETAILED DESCRIPTION OF THE INVENTION

The present disclosure generally involves an elliptical (shape) monoconical antenna apparatus for disposition in relation to a ground plane, its method of fabrication, and its method of use. The elliptical (shape) monoconical antenna apparatus is configured to increase an antenna aperture, wherein the apparatus comprises an elliptical shape having an increasable cross-sectional area and a constant height, and whereby antenna directivity towards a horizon is increasable. The elliptical monoconical antenna apparatus is further configured to properly match an antenna feed, whereby mismatch effects are eliminated from antenna directivity.

In accordance with an embodiment of the present disclosure, an elliptical conical antenna apparatus for enhancing antenna performance, comprises: an elliptical portion having planform cross-section comprising a generally circular configuration and an elevational cross-section comprising at least a partial elliptical configuration; a conical portion comprising at least one of a conical configuration and a frustoconical configuration, the conical portion coupled with the elliptical portion; and a modifier feed, the modifier feed comprising a first feed element and a second feed element, whereby the antenna apparatus is configured to perform as a monopole antenna at a low frequency, whereby the antenna apparatus is configured to perform as a hybrid monopole-biconical antenna at a high frequency.

In accordance with an embodiment of the present disclosure, a method of fabricating an elliptical conical antenna apparatus for enhancing antenna performance, comprises: providing an elliptical portion having planform cross-section comprising a generally circular configuration and an elevational cross-section comprising at least a partial elliptical configuration; providing a conical portion comprising at least one of a conical configuration and a frustoconical configuration, the conical portion coupled with the elliptical portion; and providing a modifier feed, providing the modifier feed comprising providing a first feed element and providing a second feed element, thereby configuring the antenna apparatus to perform as a monopole antenna at a low frequency, thereby configuring the antenna apparatus to perform as a hybrid monopole-biconical antenna at a high frequency.

In accordance with an embodiment of the present disclosure, a method of improving antenna performance by way of an elliptical conical antenna apparatus, comprises: providing the elliptical conical antenna apparatus, providing the elliptical conical antenna apparatus comprising: providing an elliptical portion having planform cross-section comprising a generally circular configuration and an elevational cross-section comprising at least a partial elliptical configuration; providing a conical portion, providing the conical portion comprising at least one of providing a conical configuration and providing a frustoconical configuration, the conical portion coupled with the elliptical portion, and providing a modifier feed, providing the modifier feed comprising providing a first feed element and providing a second feed element, wherein providing the first feed element and providing the second feed element, together, comprise converging the first feed element and the second feed element at a feed point, wherein providing the modifier feed further comprises providing a radio frequency (RF) feed line configured to at least one of: couple with at least one of the elliptical portion and the conical portion and couple with the second feed element; thereby configuring the antenna apparatus to perform as a monopole antenna at a low frequency, thereby configuring the antenna apparatus to perform as a hybrid monopole-biconical antenna at a high frequency and transmitting a signal through the RF feed line.

Further, in accordance with some embodiments of the present disclosure, the elliptical monoconical antenna apparatus is further configured to operate as an omnidirectional monoconical antenna in a range from frequencies, such as approximately 30 MHz to approximately 18 GHz. The design is scalable in such way where the bigger the antenna size the lower the frequency improvement.

In accordance with some embodiments of the present disclosure, the elliptical monoconical antenna apparatus comprises a reduced size in a range of approximately 50% that of a related art antenna, such as a conventional biconical antenna having a typical full size in a range of ½-wave antenna size, whereby the reduced size comprises a ¼-wave antenna size, whereby the elliptical monoconical antenna apparatus is operable as a monopole antenna. The elliptical monoconical antenna apparatus disposable in relation to a ground plane, such as on a ground plane, facilitates upwardly tilting of an antenna beam, e.g., by a nominal angle in a range of approximately 45 degrees to approximately 55 degrees, whereby the elliptical monoconical antenna apparatus is adapted to upwardly radiate. For at least the elliptical shape of the antenna apparatus, an antenna aperture is effected having a size that is larger than that of related art antenna apertures, whereby the antenna apparatus has enhanced performance in low frequency ranges, such as approximately 30 MHz to approximately 200 MHz. Additionally, for at least the elliptical shape, the antenna apparatus is configured to focus the antenna energy and to improve directivity toward a horizon, whereby the antenna apparatus is operable as an omnidirectional antenna.

Figure 2:
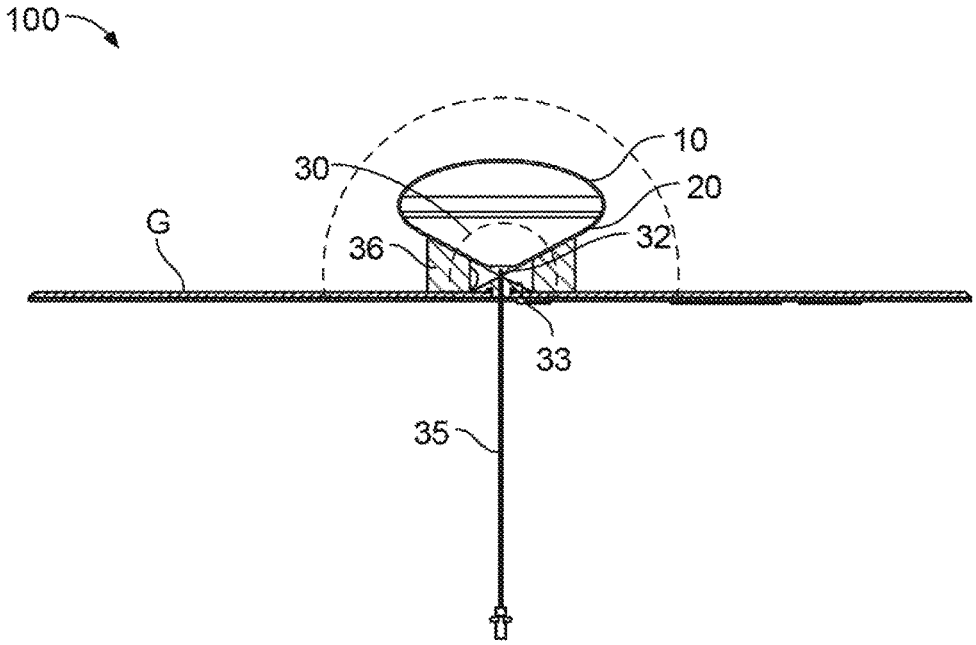
FIG. 2 is a diagram illustrating an elevational side view of an elliptical conical antenna apparatus, as shown in FIG. 1, in accordance with an embodiment of the present disclosure.
Figure 3:
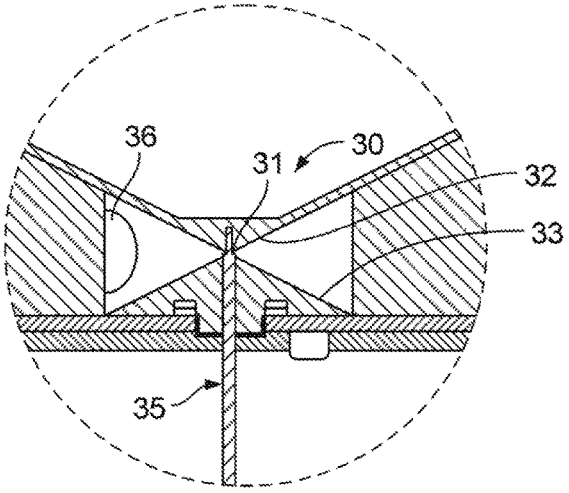
FIG. 3 is a diagram illustrating a cut-away view of the modifier feed of an antenna apparatus, as shown in FIG. 2, in accordance with an embodiment of the present disclosure.

Referring to FIG. 1, this diagram illustrates, in a top perspective view, an elliptical conical antenna apparatus 100, in accordance with an embodiment of the present disclosure. The elliptical mono-conical antenna apparatus 100 comprises an elliptical portion 10 and a conical portion 20. The apparatus 100 further comprises a modifier feed 30 and a ground plane G, such as a finite ground plane, wherein the modifier feed 30 is disposable in relation to, and configured to couple with, a ground plane G. The modifier feed 30 comprises a feed element 32 and a feed element 33, wherein the feed element 32 and the feed element 33 converge at a feed point 31 (FIGS. 2 and 3). At least one of the feed element 32 and the feed element 33 is configured to couple, or is integrally formed, with at least one of the elliptical portion 10, the conical portion 20, and the ground plane G. At least one of the feed element 32 and the feed element 33 is configured in at least one of size and shape for matching impedance. At low frequencies, the apparatus 100 is configured to perform as a monopole antenna; and, at high frequencies, the apparatus 100 is configured to perform as a hybrid monopole-biconical antenna by way of the modifier feed 30.

Referring to FIG. 2, this diagram illustrates, in an elevational side view, an elliptical conical antenna apparatus 100, as shown in FIG. 1, in accordance with an embodiment of the present disclosure. The elliptical portion 10 is an upper portion of the apparatus 100; and the conical portion 20 is the lower portion of the apparatus 100. The elliptical portion 10 and the conical portion 20 may be separately or integrally formed. The modifier feed 30 further comprises a radio-frequency (RF) feed line 35 configured to electrically couple with the feed element 33, wherein the feed element 33 is configured to electrically couple with the ground plane G. The apparatus 100 further comprises a coupling structure 36, such as an adhesive, e.g., a low-dielectric foam, at least one fastener, e.g., a screw, a bonded pin, a peg, and biscuit joinery, for mechanically coupling at least two components of the modifier feed 30, e.g., in relation to the ground plane G.

Referring to FIG. 3, this diagram illustrates, in a cut-away view, the modifier feed 30 of an antenna apparatus 100, as shown in FIG. 2, in accordance with an embodiment of the present disclosure. The modifier feed 30 further comprises an RF feed line 35 configured to electrically couple with the feed element 33, wherein the feed element 33 is configured to electrically couple with the ground plane G. The apparatus 100 further comprises a coupling structure 36, such as an adhesive, e.g., a low-dielectric foam, for mechanically coupling at least two components of the modifier feed 30, e.g., in relation to the ground plane G. The RF feed line 35 comprises additional features, such as those related to antenna impedance, as described in the priority document, U.S. patent application Ser. No. 14/059,520, filed on Oct. 22, 2013, entitled "Omni-Directional Antenna with Extended Frequency Range".

Figure 4A:
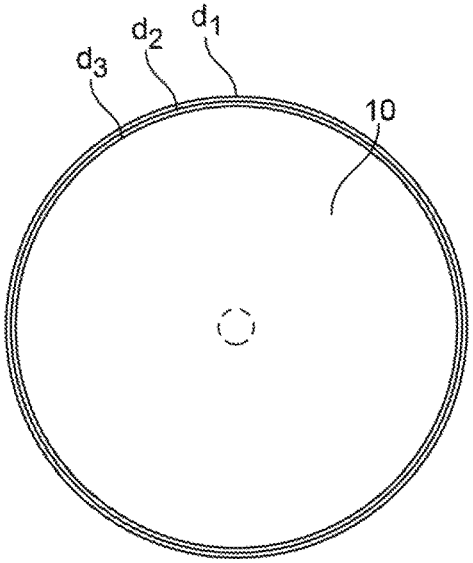
FIG. 4A is a diagram illustrating a top view of the upper portion or the elliptical portion of the apparatus, as shown in FIGS. 1 and 2, in accordance with an embodiment of the present disclosure.

Referring to FIG. 4A, this diagram illustrates, in a top view, the upper portion or the elliptical portion 10 of the apparatus 100, as shown in FIGS. 1 and 2, in accordance with an embodiment of the present disclosure. As shown, the upper portion of the antenna apparatus 100 comprises a planform cross-section having a generally circular shape. The elliptical portion 10 comprises a variable range of dimensions as a function of frequency range as well as frequency bandwidth, such as approximately from 30 MHz to approximately 18 GHz, by example only. The lower portion or the conical portion 20 of the apparatus 100 comprises a variable range of dimensions, such as a variable range of diameters, e.g., diameters $d_1$, $d_2$, $d_3$, by example only, as a function of desired, or predetermined, performance characteristics, such as a frequency, e.g., an operating frequency, wherein the diameter is decreasable if the frequency increases, and wherein the diameter is increasable if the frequency decreases.

Figure 4B:
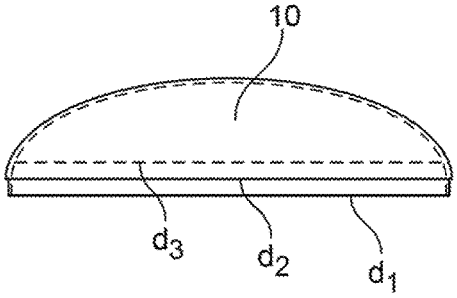
FIG. 4B is a diagram illustrating an elevational side view of the upper portion or the elliptical portion of the apparatus, as shown in FIG. 4A, in accordance with an embodiment of the present disclosure.

Referring to FIG. 4B, this diagram illustrates, in an elevational side view, the upper portion or the elliptical portion 10 of the apparatus 100, as shown in FIG. 4A, in accordance with an embodiment of the present disclosure. As shown, the upper portion of the antenna apparatus 100 an elevational cross-section having a generally an elliptical shape or a partial elliptical shape. The elliptical portion 10 comprises a variable range of dimensions as a function of frequency range as well as frequency bandwidth, such as a range of approximately 30 MHz to approximately 18 GHz, by example only. The lower portion or the conical portion 20 of the apparatus 100 comprises a variable range of dimensions, such as a variable range of diameters, e.g., diameters $d_1$, $d_2$, $d_3$, by example only, as a function of desired, or predetermined, performance characteristics, such as a frequency, e.g., an operating frequency, wherein at least one of a diameter and a height is proportional to a wavelength, e.g., an operating wavelength, wherein at least one of the diameter and the height is inversely proportional to a frequency, e.g., an operating frequency, and wherein at least one of the diameter and the height is proportional to a constant C.

Figure 5A:
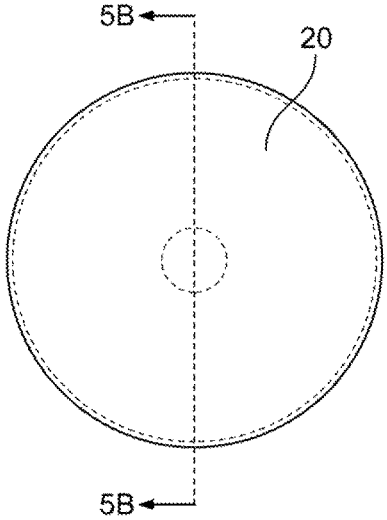
FIG. 5A is a diagram illustrating a bottom view of the lower portion or the conical portion of the apparatus, as shown in FIGS. 1 and 2, in accordance with an embodiment of the present disclosure.

Referring to FIG. 5A, this diagram illustrates, in a bottom view, the lower portion or the conical portion 20 of the apparatus 100, as shown in FIGS. 1 and 2, in accordance with an embodiment of the present disclosure. As shown, the conical portion 20, comprising a generally conical shape, or frustoconical shape, transitions into elliptical portion 10, comprising the elliptical shape, in contrast to related art conical antennas which have a conical portion that transitions into a spherical portion. The elliptical portion 10 comprises a variable range of dimensions as a function of frequency range as well as frequency bandwidth, such as approximately from 30 MHz to approximately 18 GHz, by example only. The lower portion or the conical portion 20 of the apparatus 100 comprises a variable range of dimensions, such as a variable range of diameters, e.g., diameters $d_1$, $d_2$, $d_3$, by example only, as a function of desired, or predetermined, performance characteristics.

Figure 5B:
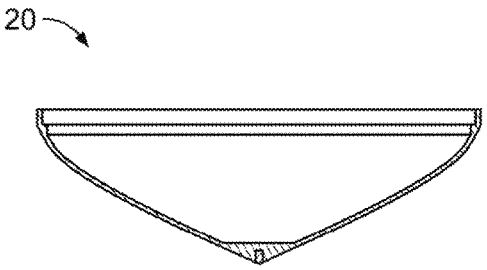
FIG. 5B is a diagram illustrating an elevational cross-sectional view of the lower portion or the conical portion of the apparatus, as shown in FIG. 5A, in accordance with an embodiment of the present disclosure.

Referring to FIG. 5B, this diagram illustrates, in an elevational cross-sectional view, taken at cross-section A-A, the lower portion or the conical portion 20 of the apparatus 100, as shown in FIG. 5A, in accordance with an embodiment of the present disclosure. As shown, the conical portion 20, comprising a generally conical shape, or frustoconical shape, transitions into the elliptical portion 10, comprising the elliptical shape, in contrast to related art conical antennas which have a conical portion that transitions into a spherical portion. The elliptical portion 10 comprises a variable range of dimensions as a function of frequency range as well as frequency bandwidth, such as approximately from 30 MHz to approximately 18 GHz, by example only. The lower portion or the conical portion 20 of the apparatus 100 comprises a variable range of dimensions, such as a variable range of diameters, e.g., diameters $d_1$, $d_2$, $d_3$, by example only, as a function of desired, or predetermined, performance characteristics.

Figure 6:
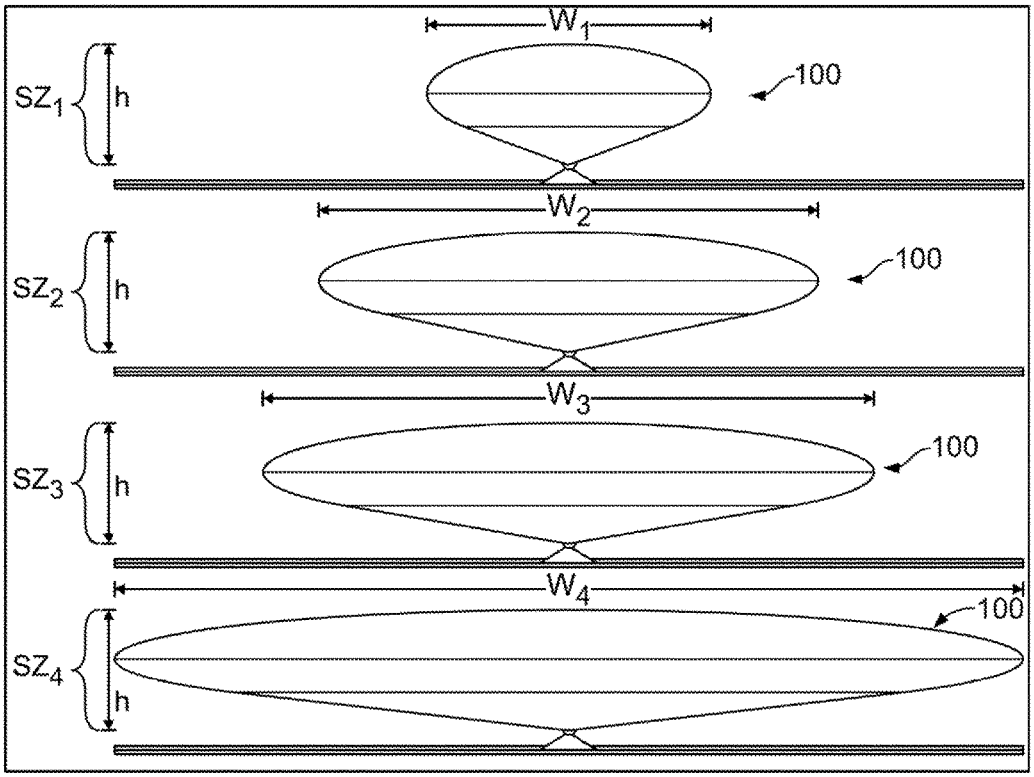
FIG. 6 is a diagram illustrating an elevational side view of an elliptical conical antenna apparatus, configurable in a range of sizes, in accordance with an embodiment of the present disclosure.

Referring to FIG. 6, this diagram illustrates, in an elevational side view, an elliptical conical antenna apparatus 100, configurable in a range of sizes $SZ_1$, $SZ_2$, $SZ_3$, $SZ_4$, wherein $SZ_1$, $SZ_2$, $SZ_3$, $SZ_4$ are distinct sizes, by example only, in accordance with an embodiment of the present disclosure. The elliptical conical antenna apparatus 100 of the present disclosure comprises a configuration that facilitates increasing energy transmission on the horizon in contrast to related art spherical conical antennas. As shown, the elliptical conical antenna apparatus 100 is scalable in size while also maintaining a constant height h, wherein an antenna pattern is shiftable to the horizon at an elevation equal to approximately zero at higher frequencies, such as in a range of approximately 30 MHz to approximately 18 GHz.

Figure 7:
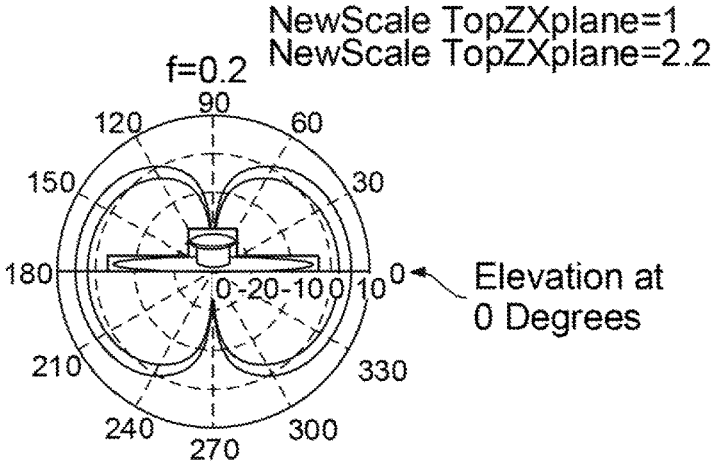
FIG. 7 is a radial graphical diagram illustrating a low-frequency directivity pattern of an elliptical conical antenna apparatus, in accordance with an embodiment of the present disclosure.

Referring to FIG. 7, this radial graphical diagram illustrates a low-frequency directivity pattern of an elliptical conical antenna apparatus 100, wherein an antenna aperture is increasable, and wherein an antenna gain is increasable at low frequencies in a range of approximately 30 MHz to approximately 200 MHz, in accordance with an embodiment of the present disclosure. As shown, the low-frequency comprises approximately 30 MHz to 200 MHz by example only.

Figure 8:
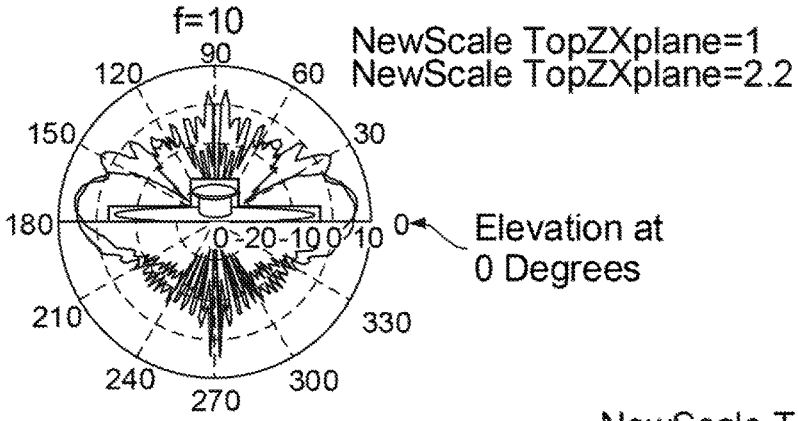
FIG. 8 is a radial graphical diagram illustrating a mid-frequency directivity pattern of an elliptical conical antenna apparatus, in accordance with an embodiment of the present disclosure.

Referring to FIG. 8, this radial graphical diagram illustrates a mid-frequency directivity pattern of an elliptical conical antenna apparatus 100, wherein an antenna aperture is increasable, wherein an antenna gain is shiftable in relation to a horizon, and wherein an elevation is equal to zero as an elliptical shape of the elliptical portion 10 is increasable, in accordance with an embodiment of the present disclosure. As shown, the mid-frequency comprises approximately 200 MHz to 1 GHz by example only.

Figure 9:
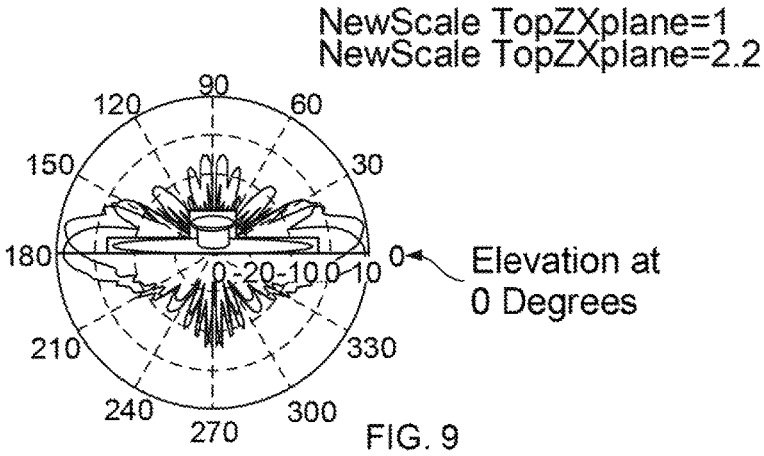
FIG. 9 is a radial graphical diagram illustrating a high-frequency directivity pattern of an elliptical conical antenna apparatus, in accordance with an embodiment of the present disclosure.

Referring to FIG. 9, this radial graphical diagram illustrates a high-frequency directivity pattern of an elliptical conical antenna apparatus 100, wherein an antenna aperture is increasable, wherein an antenna gain is shiftable in relation to a horizon, and wherein an elevation is equal to zero as an elliptical shape of the elliptical portion 10 is increasable, in accordance with an embodiment of the present disclosure. As shown, the high-frequency comprises approximately 1 GHz to approximately 18 GHz by example only.

Figure 10:
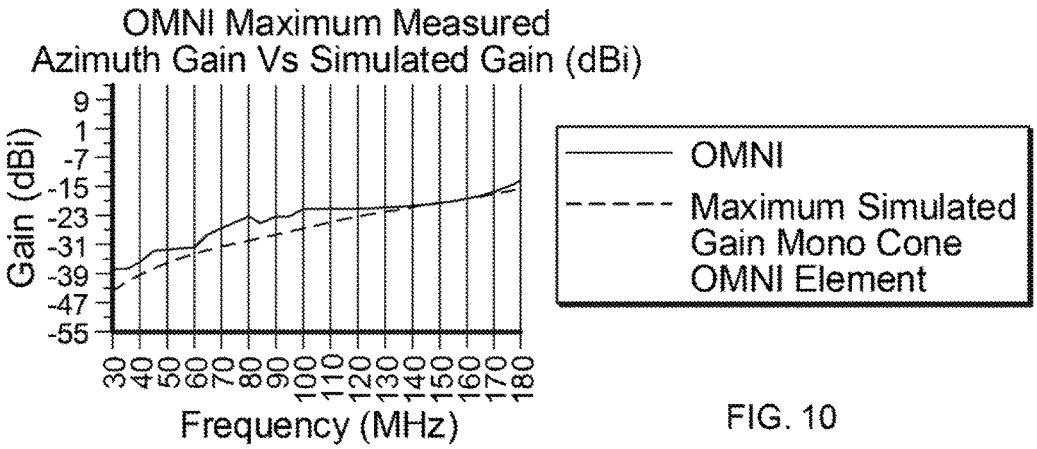
FIG. 10 is a graph illustrating gain as a function of frequency, wherein a maximum measured azimuth gain of an omnidirectional antenna is represented by a solid curve, wherein a simulated gain of an elliptical conical antenna apparatus is represented by a broken curve, and wherein the simulated gain of the elliptical monoconical antenna apparatus approximates the maximum measured azimuth gain of an omnidirectional antenna, in accordance with an embodiment of the present disclosure.

Referring to FIG. 10, this graphical diagram illustrates gain (dBi), represented by the ordinate axis, as a function of frequency (MHz), represented by an abscissa axis, wherein the frequency comprises a low-frequency range of approximately 30 MHz to approximately 180 MHz, wherein a maximum measured azimuth gain of an omnidirectional antenna is represented by a solid curve, wherein a simulated gain, e.g., an elevation gain, of an elliptical monoconical antenna apparatus 100 is represented by a broken curve, and wherein the simulated gain of the elliptical monoconical antenna apparatus 100 approximates the maximum measured azimuth gain of an omnidirectional antenna, in accordance with an embodiment of the present disclosure.

Figure 11:
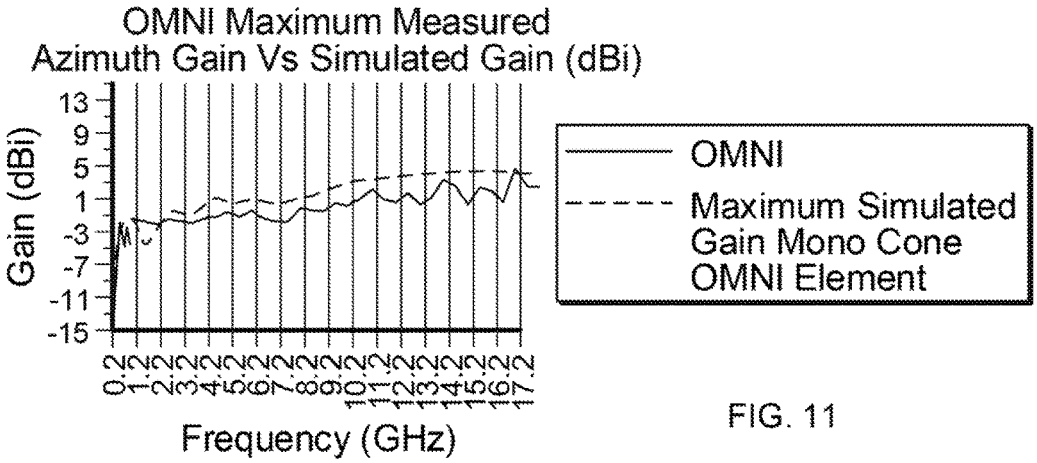
FIG. 11 is a graph illustrating gain as a function of frequency, wherein a maximum measured azimuth gain of an omnidirectional antenna is represented by a solid curve, wherein a simulated gain of an elliptical conical antenna apparatus is represented by a broken curve, and wherein the simulated gain of the elliptical conical antenna apparatus approximates the maximum measured azimuth gain of an omnidirectional antenna, in accordance with an embodiment of the present disclosure.

Referring to FIG. 11, this graphical diagram illustrates gain (dBi), represented by the ordinate axis, as a function of frequency (GHz), represented by an abscissa axis, wherein the frequency comprises a frequency range of approximately 0.2 GHz to approximately 18 GHz, wherein a maximum measured azimuth gain of an omnidirectional antenna is represented by a solid curve, wherein a simulated gain, e.g., an elevation gain, of an elliptical monoconical antenna apparatus 100 is represented by a broken curve, and wherein the simulated gain of the elliptical monoconical antenna apparatus 100 *e* approximates the maximum measured azimuth gain of an omnidirectional antenna, in accordance with an embodiment of the present disclosure.

Figure 12:
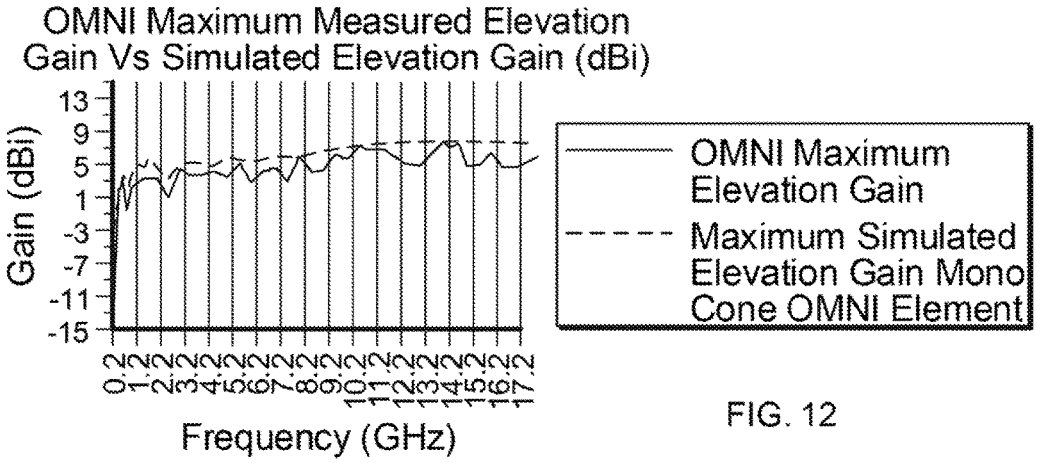
FIG. 12 is a graph illustrating gain as a function of frequency, wherein a maximum measured azimuth gain of an omnidirectional antenna is represented by a solid curve, wherein a simulated gain, e.g., an elevation gain, of an elliptical conical antenna apparatus is represented by a broken curve, and wherein the simulated gain of the elliptical conical antenna apparatus approximates the maximum measured azimuth gain of an omnidirectional antenna, in accordance with an embodiment of the present disclosure.

Referring to FIG. 12, this graphical diagram illustrates gain (dBi), represented by the ordinate axis, as a function of frequency (GHz), represented by an abscissa axis, wherein the frequency comprises a frequency range of approximately 0.2 GHz to approximately 18 GHz, wherein a maximum measured azimuth gain of an omnidirectional antenna is represented by a solid curve, wherein a simulated gain, e.g., an elevation gain, of an elliptical monoconical antenna apparatus 100 is represented by a broken curve, and wherein the simulated gain of the elliptical monoconical antenna apparatus 100 approximates the maximum measured azimuth gain of an omnidirectional antenna, in accordance with an embodiment of the present disclosure.

Figure 13:
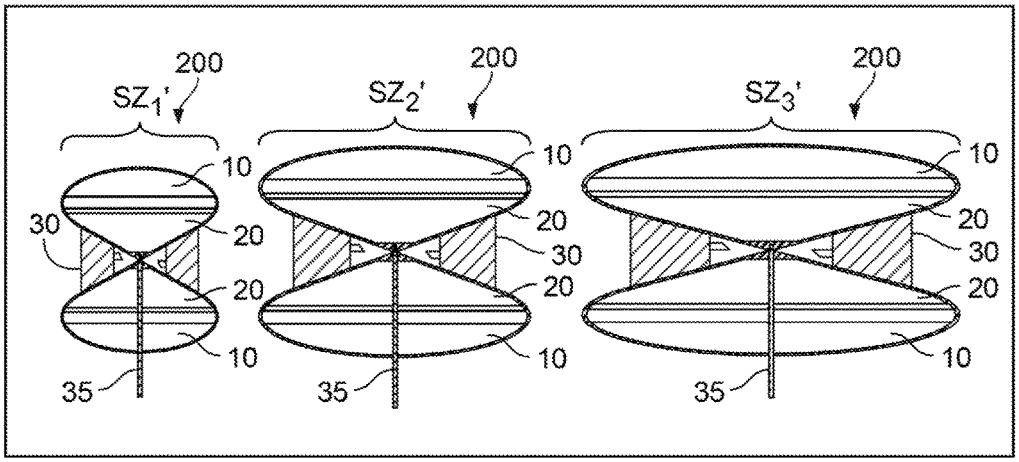
FIG. 13 is a diagram illustrating elevational side views of a bielliptical biconical antenna apparatus, configurable in a plurality of sizes, in accordance with alternative embodiments of the present disclosure.

Referring to FIG. 13, this diagram illustrates, in elevational side views, a bi-elliptical bi-conical antenna apparatus 200, configurable in a plurality of sizes $SZ_1'$, $SZ_2'$, $SZ_3'$, by example only, in accordance with alternative embodiments of the present disclosure. The bi-elliptical bi-conical antenna apparatus 200 comprises a symmetrical elliptical conical shape is utilizable for simulating a biconical antenna, wherein the bi-elliptical bi-conical antenna apparatus 200. Alternatively, the antenna apparatus 200 may be asymmetrical or partially asymmetrical.

Figure 14:
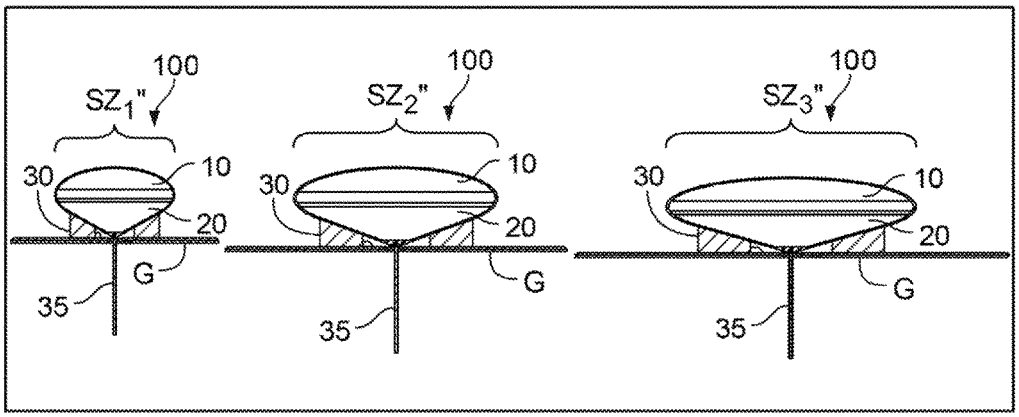
FIG. 14 is a diagram illustrating side views of an elliptical monoconical antenna apparatus, disposable in relation to a ground plane, absent a bottom feed, the elliptical monoconical antenna apparatus configurable in a plurality of sizes, in accordance with alternative embodiments of the present disclosure.

Referring to FIG. 14, this diagram illustrates, in side views, an elliptical mono-conical antenna apparatus, such as the antenna apparatus 100, disposable in relation to a ground plane G, absent a bottom feed, the elliptical mono-conical antenna apparatus 100 configurable in a plurality of sizes $SZ_1''$, $SZ_2''$, $SZ_3''$, by example only, in accordance with alternative embodiments of the present disclosure.

Figure 15:
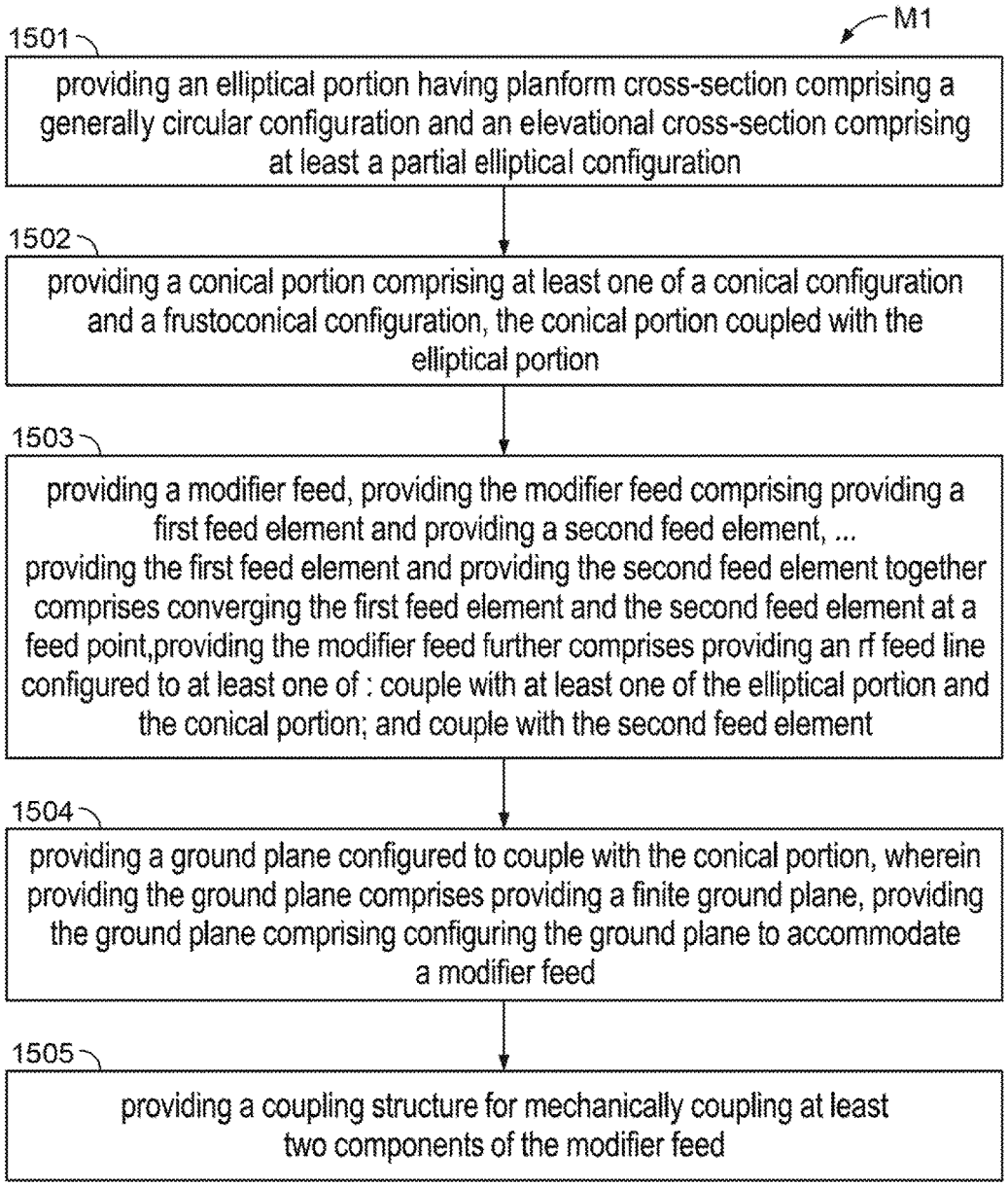
FIG. 15 is a flow diagram illustrating a method of fabricating an elliptical conical antenna apparatus for enhancing antenna performance, in accordance with an embodiment of the present disclosure.

Referring to FIG. 15, this flow diagram illustrates a method M1 of fabricating an elliptical conical antenna apparatus for enhancing antenna performance, in accordance with an embodiment of the present disclosure. The method M1 comprises: providing an elliptical portion having planform cross-section comprising a generally circular configuration and an elevational cross-section comprising at least a partial elliptical configuration, as indicated by block 1501;

providing a conical portion comprising at least one of a conical configuration and a frustoconical configuration, the conical portion coupled with the elliptical portion, as indicated by block 1502; and providing a modifier feed, providing the modifier feed comprising providing a first feed element and providing a second feed element, thereby configuring the antenna apparatus to perform as a monopole antenna at a low frequency, and as a hybrid monopole-biconical antenna at a high frequency, as indicated by block 1503.

Still referring to FIG. 15, the method M1 further comprises: providing a ground plane configured to couple with the conical portion, wherein providing the ground plane comprises providing a finite ground plane, as indicated by block 1504. Providing the first feed element and providing the second feed element, together, as indicated by block 1503, comprise converging the first feed element and the second feed element at a feed point. Providing the modifier feed 30 further comprises providing an RF feed line configured to at least one of: couple with at least one of the elliptical portion and the conical portion; and couple with the second feed element.

Still referring to FIG. 15, in the method M1, providing the ground plane, as indicated by block 1504, comprises configuring the ground plane to accommodate a modifier feed. Providing the elliptical portion, as indicated by block 1501, and providing the conical portion, as indicated by block 1502, together, comprise one of: separately forming the elliptical portion and the conical portion; and integrally forming the elliptical portion and the conical portion (not shown). The method M1 further comprises providing a coupling structure for mechanically coupling at least two components of the modifier feed, as indicated by block 1505.

Still referring to FIG. 15, in the method M1, providing the elliptical portion, as indicated by block 1501, and providing the conical portion, as indicated by block 1502, together, comprise providing a constant height, providing the elliptical portion, as indicated by block 1501, and providing the conical portion, as indicated by block 1502, together, comprise providing a variable width, providing the elliptical portion, as indicated by block 1501, and providing the conical portion, as indicated by block 1502, together, comprises configuring the elliptical portion and the conical portion, together, for simulating at least one of an omnidirectional antenna and a biconical antenna having enhanced performance characteristics, and whereby antenna performance is enhanceable for a plurality of frequency ranges and a plurality of frequency bandwidths.

Figure 16:
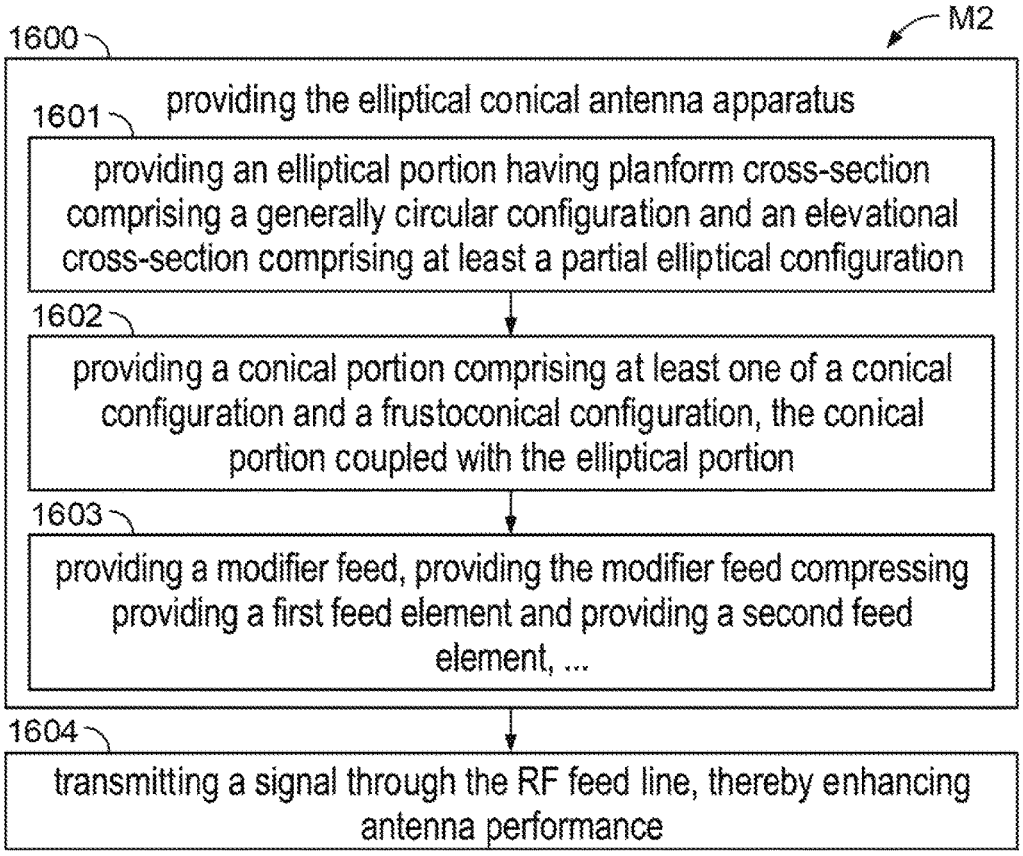
FIG. 16 is flow diagram illustrating a method of enhancing antenna performance by way of an elliptical conical antenna apparatus, in accordance with an embodiment of the present disclosure.

Referring to FIG. 16, this flow diagram illustrates a method M2 of enhancing antenna performance by way of an elliptical conical antenna apparatus, in accordance with an embodiment of the present disclosure. The method M2 comprises: providing the elliptical conical antenna apparatus, as indicated by block 1600, providing the elliptical conical antenna apparatus comprising: providing an elliptical portion having planform cross-section comprising a generally circular configuration and an elevational cross-section comprising at least a partial elliptical configuration, as indicated by block 1601; providing a conical portion comprising at least one of a conical configuration and a frustoconical configuration, the conical portion coupled with the elliptical portion, as indicated by block 1602, and providing a modifier feed 30, providing the modifier feed 30 comprising providing a first feed element and providing a second feed element, wherein providing the first feed element and providing the second feed element, together, comprise converging the first feed element and the second feed element at a feed point, wherein providing the modifier feed further comprises providing an RF feed line configured to at least one of: couple with at least one of the elliptical portion 10 and the conical portion; and couple with the second feed element, thereby configuring the antenna apparatus to perform as a monopole antenna at a low frequency and as a hybrid monopole-biconical antenna at a high frequency, as indicated by block 1603; and transmitting a signal through the RF feed line 35, as indicated by block 1604.

It is understood that many additional changes in the details, materials, steps, and arrangement of parts, which have been herein described and illustrated to explain the nature of the embodiment, may be made by those skilled in the art within the principle and scope of the embodiment as expressed in the appended claims.

What is claimed:

1. An oblate ellipsoidal conical antenna apparatus for enhancing antenna performance, comprising:

an oblate ellipsoidal portion having planform cross-section comprising a generally circular configuration and an elevational cross-section comprising at least a partial oblate ellipsoidal configuration;

a conical portion comprising at least one of a conical configuration and a frustoconical configuration, the conical portion coupled with the oblate ellipsoidal portion; and a modifier feed, the modifier feed comprising a first feed element and a second feed element, whereby the antenna apparatus is configured to perform as a monopole antenna at a low frequency and as a hybrid monopole-biconical antenna at a high frequency.

2. The apparatus of claim 1, further comprising a ground plane configured to couple with the conical portion.

3. The apparatus of claim 2, wherein the ground plane comprises a finite ground plane.

4. The apparatus of claim 2, wherein the ground plane is configured to accommodate a modifier feed.

5. The apparatus of claim 1, wherein the first feed element and the second feed element converge at a feed point.

6. The apparatus of claim 5, wherein the modifier feed further comprises an RF feed line configured to at least one of: couple with at least one of the oblate ellipsoidal portion and the conical portion; and couple with the second feed element, and wherein at least one of the first feed element and the second feed element is configured to one of: couple with at least one of the oblate ellipsoidal portion, the conical portion, and the ground plane; and integrally form with at least one of the oblate ellipsoidal portion, the conical portion, and the ground plane.

7. The apparatus of claim 5, further comprising a coupling structure for mechanically coupling at least two components of the modifier feed.

8. The apparatus of claim 1, wherein the oblate ellipsoidal portion and the conical portion are one of separately formed and integrally formed.

9. The apparatus of claim 1, wherein the oblate ellipsoidal portion and the conical portion, together, comprise a constant height, wherein the oblate ellipsoidal portion and the conical portion, together, comprise a variable width, and whereby antenna performance is enhanceable for a plurality of frequency ranges and a plurality of frequency bandwidths.

10. The apparatus of claim 1, wherein the oblate ellipsoidal portion and the conical portion are configurable for simulating at least one of an omnidirectional antenna and a biconical antenna.

11. A method of fabricating an oblate ellipsoidal conical antenna apparatus for enhancing antenna performance, comprising:

providing an ellipsoidal portion having planform cross-section comprising a generally circular configuration and an elevational cross-section comprising at least a partial oblate ellipsoidal configuration;

providing a conical portion comprising at least one of a conical configuration and a frustoconical configuration, the conical portion coupled with the oblate ellipsoidal portion; and providing a modifier feed, providing the modifier feed comprising providing a first feed element and providing a second feed element, thereby configuring the antenna apparatus to perform as a monopole antenna at a low frequency and as a hybrid monopole-biconical antenna at a high frequency.

12. The method of claim 11, further comprising providing a ground plane configured to couple with the conical portion.

13. The method of claim 12, wherein providing the ground plane comprises providing a finite ground plane.

14. The method of claim 12, wherein providing the ground plane comprises configuring the ground plane to accommodate a modifier feed.

15. The method of claim 11, wherein providing the first feed element and providing the second feed element, together, comprise converging the first feed element and the second feed element at a feed point.

16. The method of claim 15, wherein providing the modifier feed further comprises providing an RF feed line configured to at least one of: couple with at least one of the oblate ellipsoidal portion and the conical portion; and couple with the second feed element, and wherein providing at least one of the first feed element and the second feed element comprises one of: coupling at least one of the first feed element and the second feed element with at least one of the elliptical portion, the conical portion, and the ground plane; and integrally forming at least one of the first feed element and the second feed element with at least one of the oblate ellipsoidal portion, the conical portion, and the ground plane.

17. The method of claim 15, further comprising providing a coupling structure for mechanically coupling at least two components of the modifier feed.

18. The method of claim 11, wherein providing the oblate ellipsoidal portion and providing the conical portion, together, comprise one of:

separately forming the oblate ellipsoidal portion and the conical portion; and integrally forming the oblate ellipsoidal portion and the conical portion.

19. The method of claim 11, wherein providing the oblate ellipsoidal portion and providing the conical portion, together, comprise providing a constant height, wherein providing the oblate ellipsoidal portion and providing the conical portion, together, comprise providing a variable width, wherein providing the oblate ellipsoidal portion and providing the conical portion comprises configuring the oblate ellipsoidal portion and the conical portion, together, for simulating at least one of an omnidirectional antenna and a biconical antenna.

20. A method of improving antenna performance by way of an oblate ellipsoidal conical antenna apparatus, comprising:

providing the oblate ellipsoidal conical antenna apparatus, providing the oblate ellipsoidal conical antenna apparatus comprising:

providing an oblate ellipsoidal portion having planform cross-section comprising a generally circular configuration and an elevational cross-section comprising at least a partial oblate ellipsoidal configuration;

providing a conical portion comprising at least one of a conical configuration and a frustoconical configuration, the conical portion coupled with the oblate ellipsoidal portion, and providing a modifier feed, providing the modifier feed comprising providing a first feed element and providing a second feed element, wherein providing the first feed element and providing the second feed element, together, comprise converging the first feed element and the second feed element at a feed point, wherein providing the modifier feed further comprises providing an RF feed line configured to at least one of: couple with at least one of the oblate ellipsoidal portion and the conical portion and couple with the second feed element;

thereby configuring the antenna apparatus to perform as a monopole antenna at a low frequency and as a hybrid monopole-biconical antenna at a high frequency, and transmitting a signal through the RF feed line.

* * * * *